US009339945B2

(12) United States Patent
Parness et al.

(10) Patent No.: US 9,339,945 B2
(45) Date of Patent: May 17, 2016

(54) SYSTEMS AND METHODS FOR GRAVITY-INDEPENDENT GRIPPING AND DRILLING

(71) Applicant: CALIFORNIA INSTITUTE OF TECHNOLOGY, Pasadena, CA (US)

(72) Inventors: Aaron Parness, Los Angeles, CA (US); Matthew A. Frost, Pasadena, CA (US); Nitish Thatte, Kendall Park, NJ (US); Jonathan P. King, Orange Village, OH (US)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 864 days.

(21) Appl. No.: 13/623,047

(22) Filed: Sep. 19, 2012

(65) Prior Publication Data

US 2013/0068527 A1 Mar. 21, 2013

Related U.S. Application Data

(60) Provisional application No. 61/536,417, filed on Sep. 19, 2011, provisional application No. 61/539,377, filed on Sep. 26, 2011, provisional application No. 61/599,549, filed on Feb. 16, 2012.

(51) Int. Cl.
*B28D 7/00* (2006.01)
*B25D 17/28* (2006.01)

(52) U.S. Cl.
CPC *B28D 7/00* (2013.01); *B25D 17/28* (2013.01); *B25D 2250/221* (2013.01)

(58) Field of Classification Search
CPC ..... B28D 7/00; B28D 7/04; B28D 7/043; B25D 17/28; B65D 57/022; B65D 57/024; B65D 57/032; B25J 15/0095; B25J 17/00
USPC ..... 294/200, 201, 202, 204, 207, 82.1, 294/82.13, 82.15, 86.4, 61; 901/1; 180/8.1, 180/8.5, 8.6
See application file for complete search history.

(56) References Cited

U.S. PATENT DOCUMENTS 4,172,610 A * 10/1979 Johnson ..... 294/100
4,345,658 A * 8/1982 Danel et al. ..... 180/8.5
4,705,314 A * 11/1987 Moore ..... 294/115
4,729,253 A * 3/1988 Rosheim ..... 74/490.06
4,790,718 A * 12/1988 Vickers ..... 414/735
4,975,020 A * 12/1990 Kaasa ..... 414/796.9
5,356,187 A * 10/1994 McCarthy et al. ..... 294/99.1
5,551,525 A * 9/1996 Pack et al. ..... 180/8.6

(Continued)

OTHER PUBLICATIONS

Parness, A., *Anchoring Foot Mechanisms for Sampling and Mobility in Microgravity*, IEEE International Conference on Robotics and Automation, May 2011.

(Continued)

*Primary Examiner* — Dean Kramer
(74) *Attorney, Agent, or Firm* — Steinfl & Bruno LLP

(57) ABSTRACT

Systems and methods for gravity independent gripping and drilling are described. The gripping device can also comprise a drill or sampling devices for drilling and/or sampling in microgravity environments, or on vertical or inverted surfaces in environments where gravity is present. A robotic system can be connected with the gripping and drilling devices via an ankle interface adapted to distribute the forces realized from the robotic system.

16 Claims, 17 Drawing Sheets

(56) References Cited

U.S. PATENT DOCUMENTS

| | | | | |
|---|---|---|---|---|
| 7,762,362 | B2 * | 7/2010 | Cutkosky et al. | 180/8.5 |
| 2007/0034957 | A1 * | 2/2007 | Wagner et al. | 257/355 |
| 2008/0164080 | A1 * | 7/2008 | Asbeck et al. | 180/8.2 |

OTHER PUBLICATIONS

Abe, S. et al. Mass and Local Topography Measurements of Itokawa by Hayabusa, Science, vol. 312. No. 5778, 2006, 1344-1347.
Arvidson, R. et al. "Overview of the spirit mars exploration rover mission to gusev crater: Landing site to backstay rock in the columbia hills." Journal of Geophysical Research, vol. 111, 2006.
Asbeck, A. et al. "Climbing walls with microspines," IEEE ICRA, 2006.
Asbeck, A. et al., "Scaling hard vertical surfaces with compliant microspine arrays," Int J Robot Res, vol. 25, No. 12, pp. 1165-1179, 2006.
Augustine, N. et al. Seeking a Human Spaceflight Program Worthy of a Great Nation, NASA, Washington, DC, 2009.
Backes, P. et al. "Experimental results of rover-based coring and caching," IEEE Aerospace, 2011.
Bar-Cohen, Y. et al. "Ultrasonic/sonic driller/corer (USDC) as a sampler for planetary exploration," Aerospace Conference, 2001, IEEE Proceedings. , vol. 1, No., pp. 1/263-1/271 vol. 1, 2001.
"Biomimetics & Dexterous Manipulation Laboratory", http://bdml.stanford.edu retrieved on Apr. 9, 2013.
Bretl, T. et al., "Free-climbing with a multi-use robot," Experimental Robotics IX, vol. 21, pp. 449-458, 2006.
Cham, J. G., Bailey, S. A., Clark, J. E., Full, R. J. and Cutkosky, M. R., "Fast and Robust: Hexapedal Robots via Shape Deposition Manufacturing," The International Journal of Robotics Research. vol. 21 Issue 10—Publication Date: Oct. 1, 2002.
Cushing, G. et al. "Caves on mars: Candidate sites for astrobiological exploration," Astrobiology Science Conference, 2010.
Cushing, G. et al. "Themis observes possible cave skylights on mars," Geophysical Research Letters, vol. 34, 2007.
Cutkosky, M. R. and Kim, S., "Design and fabrication of multi-material structures for bioinspired robots," The Royal Society. 2011.
Desbiens, A. et al. "Landing, perching and taking off from vertical surfaces," International Journal of Robotics Research, 2011.
Desbiens, A. L. et al. "Hybrid aerial and scansorial robotics," IEEE ICRA, 2010.
Des Marais, D. et al. The NASA Astrobiology Roadmap, Astrobiology, vol. 8, No. 4, 2008.
Finzi, A. et al., SD2—How to Sample a Comet, Space Science Reviews, vol. 128, 2007, 281-299.
Fujiwara A. et al., The Rubble-Pile Asteroid Itokawa as Observed by Hayabusa, Science, vol. 312, No. 5778, 2006, 1330-1334.
Gripper Demo.MOV from http://www.youtube.com/watch?v=8v4QRRP5rjE posted on Dec. 17, 2010 and retrieved on May 9, 2013.
Huntsberger, T. et al. "Tressa: Teamed robots for exploration and science on steep areas," Journal of Field Robotics, vol. 24, pp. 1015-1031, 2007.
Kennedy, B. et al. "Lemur Ilb: A robotic system for steep terrain access," Industrial Robot: An International Journal, vol. 33, pp. 265-269, 2006.
Kim, S. et al. "Design and fabrication of multi-material structures for bio-insired robots," Journal of the Royal Society, p. 18, 2008.
Kim, S. et al. "Spinybot II: climbing hard walls with compliant microspines," Advanced Robotics, 2005. ICAR '05. Proceedings., 12th International Conference on Advanced Robotics, pp. 601-606, Jun. 2005.
Landis, R. et al. A Piloted Orion Flight to a Near-Earth Object: A Feasibility Study, AIAA Space Ops, 2009.
Lauretta, D. Astrobiology Research Priorities for Primitive Asteroids, posted on NAI website 2009.
Leveille, R. et al. "Lava tubes and basaltic caves as astrobiological targets on earth and mars: A review," Planetary and Space Science, vol. 58, pp. 592-598, 2010.
McEwen, A. et al., "Seasonal flows on warm martian slopes," Science, vol. 333, pp. 740-743, 2011.
Merz, R. et al. Shape Deposition Manufacturing Proceedings, of the 1994 Solid Freeform Fabrication Symposium, 1994.
Nesnas, I. et al. "Axel mobility platform for steep terrain excursions and sampling on planetary surfaces," IEEE Aerospace Conference, 2008.
Chang, K., Obama vows renewed space program, The New York Times, Apr. 15, 2010.
Okon, A. et al. "Mars science laboratory drill," 40th Aerospace Mechanisms Symposium, 2010.
Saito, J. et al. "Detailed images of asteroid 25143 itokawa from hayabusa," Science, vol. 312, pp. 1341-1344, 2006.
Sharma, I. et al. "Dynamical passage to approximate equilibrium shapes for spinning, gravitating rubble asteroids," Icarus, vol. 200, pp. 304-322, 2009.
Spenko, M. et al. "Foot design and integration for bioinspired climbing robots," Proceedings of SPIE, 2006.
Spenko, M. et al. Biologically Inspired Climbing with a Hexapedal Robot, J. of Field Robotics, vol. 25, No. 4-5, 2008, 223-242.
Squires, S. et al. "Vision and voyages for planetary science in the decade 2013-2022," National Research Council Publications, 2011.
Squyres, S. et al. "Exploration of victoria crater by the mars rover opportunity," Science, vol. 324, pp. 1058-1061, 2009.
Veverka, J. et al. "The landing of the near-shoemaker spacecraft on on asteroid 433 eros," Nature, vol. 413, pp. 390-393, 2001.
Yano, H. et al., Touchdown of the Hayabusa Spacecraft at the Muses Sea on Itokawa, Science, vol. 312, No. 5778, 2006 , 1350-1353.
Younse, P. et al. "A sample handling, encapsulation, and containerization subsystem concept for mars sample caching missions," International Planetary Probe Workshop, 2010.
Zacny, K. et al. Drilling Systems for Extraterrestrial Subsurface Exploration Astrobiology, vol. 8, No. 3, 2008.
Parness, A. et al. Microgravity Coring: A Self-Contained Anchor and Drill for Consolidated Rock. IEEEAC Paper #1335, Version 1, Updated Sep. 14, 2011.
Parness, A. et al. Gravity-Independent Mobility and Drilling on Natural Rock Using Microspines. Conference on Robotics and Automation (ICRA), 2012 IEEE International. May 2012.

* cited by examiner

SYSTEMS AND METHODS FOR GRAVITY-INDEPENDENT GRIPPING AND DRILLING

CROSS REFERENCE TO RELATED APPLICATIONS

The present application claims priority to U.S. Provisional Application No. 61/536,417, filed on Sep. 19, 2011, U.S. Provisional Application No. 61/539,377, filed on Sep. 26, 2011, and U.S. Provisional Application No. 61/599,549, filed on Feb. 16, 2012, all of which are incorporated herein by reference in its entirety.

STATEMENT OF GOVERNMENT GRANT

The invention described herein was made in the performance of work under a NASA contract, and is subject to the provisions of Public Law 96-517 (35 USC 202) in which the Contractor has elected to retain title.

FIELD

The present invention relates to gripping devices and drills in micro gravity environments or on walls and ceilings when gravity is present. More in particular, it relates to systems and methods for gravity-independent gripping and drilling.

BACKGROUND

The main background literature relevant to this invention is in the field of climbing robots. Several robots have defied gravity by climbing up the walls of buildings using specialty gripping feet. For example, the RiSE robot and the spinybot robot use microspines to climb rough manmade walls like brick, stucco, and concrete. Both of these robots, and subsequent perching airplanes, human climbing paddles, and other wall-climbing robots use linear microspines as the gripping mechanism, which is patented. Other climbing robots use dactyls, which are single rigid claws that only work on penetrable surfaces like carpet and cork, and gecko-like adhesives that only work on smooth surfaces like glass.

However, none of these robots is truly gravity-independent because they only work to counter gravity, and would fail in microgravity or in other orientations where the gravity vector is in a different direction (for example climbing on the ceiling).

There is a large field of work in robotic grasping that is tangentially relevant to this work, and is reviewed here. However, this work focuses almost entirely on grasping for manipulation tasks, like gripping objects or using tools in a dexterous manner.

Similarly, there is a very well established state of the art in drilling, even for extraterrestrial robots that is only tangentially relevant to this invention as the drill itself is irrelevant to our invention of a new method of drilling in a gravity-independent manner that is applicable to all drills.

A state of the art for asteroid and comet sampling also exist, but are all single use solutions like darts and other forms of "Touch-and-Go" samplers that do not remain in contact with the surface, but rather bounce off of it and acquire sample during the collision. Other landers that have been proposed for asteroids and comets are in fact gravity dependent like the Rosetta lander and the Hayabusa rover, even though that gravity field is small.

SUMMARY

According to a first aspect, a gripping device is described, the gripping device comprising: a center housing; an array of hooks circumferentially distributed around the center housing, the array of hooks adapted to grip a surface on which the array of hooks rest; and one or more actuators connected with the center housing and the array of hooks, the one or more actuators operative to cause the array of hooks to grip or release the surface.

According to a second aspect, a device is described, the device comprising: a substantially ring-shaped mechanism surrounding a gripping device, the substantially ring-shaped mechanism operative to freely spin around the gripping device about an axis normal to a surface upon which the gripping device grips during operation of the gripping device, the substantially ring-shaped mechanism being an interface between the gripping device and a robotic system.

According to a third aspect of the present disclosure, the method includes a) using a multi-directional gripper assembly to anchor an object upon a surface, b) initiating contact between a sub-assembly of the object and the surface, the contact characterized in part by the generation of a reactive force that pushes the object away from the surface, and c) countering the reactive force by using the multi-directional gripper assembly to provide a gravity-independent grip upon the surface at a plurality of locations surrounding the object.

According to a fourth aspect of the present disclosure, a method includes retracting towards a central housing of an object, a plurality of radially-oriented grabber assemblies, the retracting action directed at allowing the plurality of radially-oriented grabber assemblies to opportunistically grab on to irregularities in a surface.

Further aspects of the disclosure are shown in the specification, drawings and claims of the present application.

BRIEF DESCRIPTION OF DRAWINGS

The accompanying drawings, which are incorporated into and constitute a part of this specification, illustrate one or more embodiments of the present disclosure and, together with the description of a few example embodiments, serve to explain the principles and implementations of the disclosure. The components in the drawings are not necessarily drawn to scale. Instead, emphasis is placed upon clearly illustrating various principles. Moreover, in the drawings, like reference numerals designate corresponding parts throughout the several views.

DETAILED DESCRIPTION

Figure 1A:
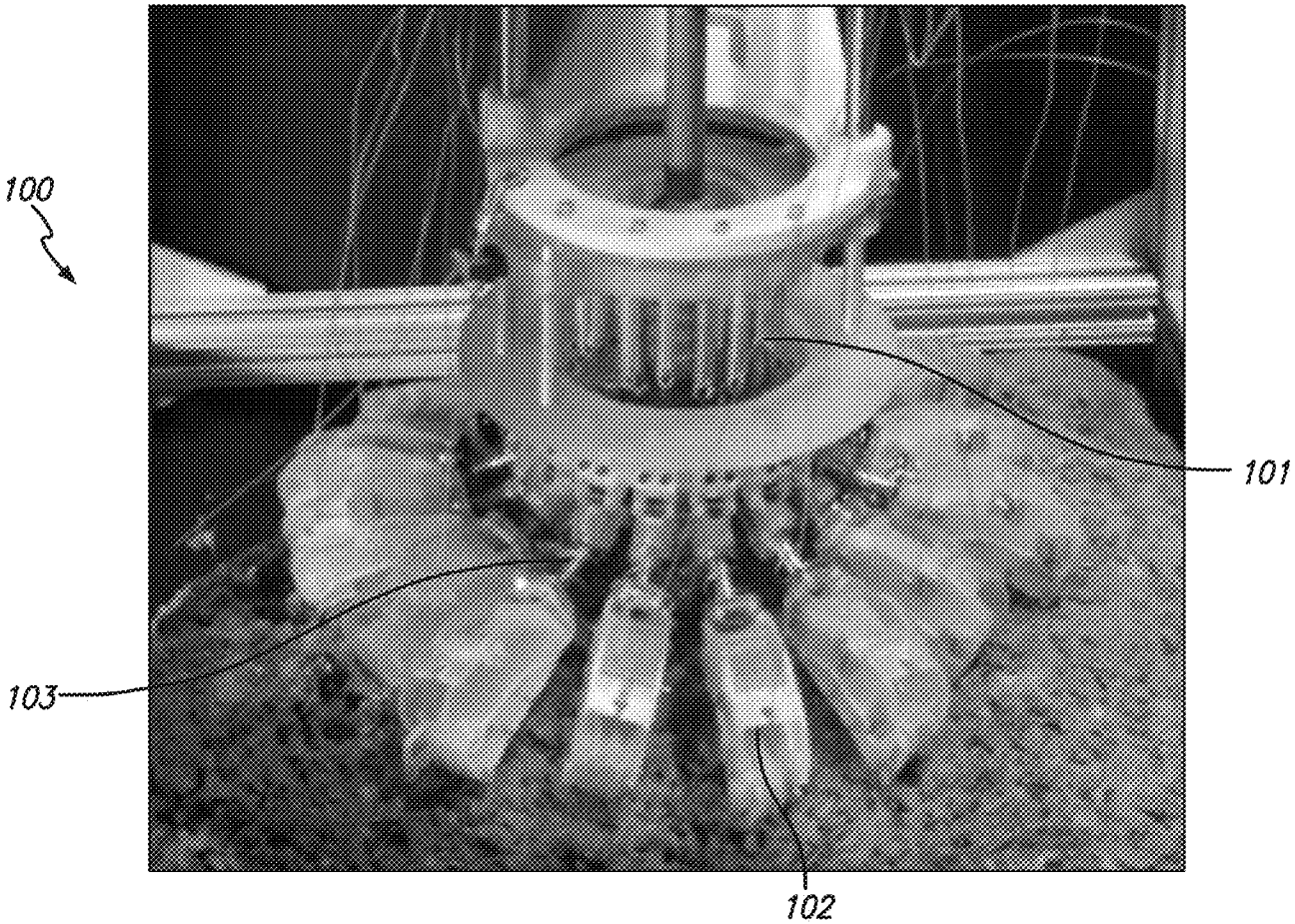
FIG. 1A shows a perspective view of a gripping device.

Throughout this description, embodiments and variations are described for the purpose of illustrating uses and implementations of the inventive concept. The illustrative description should be understood as presenting examples of the inventive concept, rather than as limiting the scope of the concept as disclosed herein.

One of the greatest challenges in a surface mission in microgravity environments (e.g., on a comet or an asteroid) is anchoring a spacecraft once it has made contact with the surface. This can be especially difficult for small Near Earth Objects (NEOs) where there is virtually no gravity. A recent analysis of NEO targets for a potential Exploration Systems Mission Directorate (ESMD) mission indicated that the largest NEOs that were reachable by a spacecraft within a few months were all less than 150 m in equivalent diameter. An object this size has approximately 0.0003% of earth's gravity (e.g., calculated using Itokawa's known density) and an escape velocity of less than 0.5 miles per hour. Any surface mission to an object of this size must anchor to the object to avoid floating away. Further, the anchor must establish its grip without exerting any force on the body that would push the lander, probe, or rover back into outer space.

It can be difficult, if not impossible to slowly drill an anchor into the body as a rock climber might drill a bolt into a cliff wall. The gripper could also be used as an end effector for a long arm that reaches out from a nearby spacecraft for a touch and go type of mission. The gripper would stabilize the arm and allow samples to be collected and in situ science to be done from a fixed platform. In the long term, this style of gripper could even be used as handholds for astronauts trying to move about on and/or near small asteroids.

Drilling a core sample on a body with no gravity can also be a significant challenge. Even drills that are designed to require small preloads like the European Space Agency's drill on the Rossetta mission, SD2, and the Low-Force Sample Acquisition System (LSAS) built by Alliance Spacesystems still need a minimum force of at least 60 N on the coring bit to be effective. On Mars or the moon, these forces are easily opposed by the weight of a rover or lander, but this force must be created by an anchoring mechanism on a NEO. Some embodiments can already grip with a 180 N gripping force, and improvements continue to be made. The gripping mechanism can be useful not only for low gravity bodies, but for steep surfaces on Mars and the moon. The strata of exposed rocky cliff on Mars contain a timeline of geological events in the rock, but are inaccessible by the class of rovers that have flown to date. To access these highly desirable targets requires the ability to anchor to and climb natural rock faces. The clawed toes used in the gripping mechanism were originally developed for climbing rough surfaces like brick and tree bark, but have been expanded in this work to attach to natural rock surfaces. Using an opposed gripping mechanism provides the maximum stability for this type of system, where reliability is critical. In a similar application on Earth, these grippers allow the exploration of cliff faces, cave ceilings, glacial ice features, and underwater reefs and sea floor, or even climbing buildings having, for example, brick walls with improved security (e.g., grip) using the same technology. This gripper can also be used as an under actuated robotic hand for grasping, manipulating, and probing rocks on the surface of a planetary body like Mars or the Moon.

A concern for operations occurring on a near-Earth asteroid are due to the differences in size and mass compared to planetary and lunar missions. Due to their low mass, commonly millions of times less than that of Earth, the gravitational field observed on these bodies is extremely weak, a condition known as microgravity. In microgravity environments, the escape velocity of an object can reach below 10 cm/s, in which case even small forces can be enough to send a robot hurtling into space. Consequently, robots, equipment and even astronauts need a method of anchoring to the asteroid surface to prevent this from occurring.

A fundamental component of what has been referred to as microspine technology is the microspine toe, which will be described in detailed later. The microspine toes can be described as identical planar mechanisms consisting of a rigid frame with elastic flexures or springs that allow them to stretch, acting as suspensions. By embedding sharp steel hook(s) in the toes, a toe can be dragged along a porous surface in an attempt to allow the microspines to opportunistically engage with surface asperities, thereby bearing the load placed on the toe. By way of example and not of limitation, asperities can be defined as pits, ledges, holes, rough spots, and/or slopes on the surface. The elasticity, or compliance, provided by the flexures or springs in each toe allows them to stretch independently of one another so that when hundreds, or potentially thousands, of such hooks engage a surface, there is an increased probability of more microspines anchoring onto asperities, and therefore an increase in the maximum probable load an anchor can support.

The gripper that will be described according to some embodiments of the present disclosure comprises several (e.g., hundreds) microspine toes that each have an independent suspension system which allows the microspine toes to conform to a textured surface (e.g., rock) and find a suitable asperity to grip. Each microspine toe consists of a steel hook embedded in a rigid frame with a compliant suspension system. By arraying tens, hundreds, or thousands, of the microspine toes, large loads can be supported and shared between many attachment points. The hooks can attach to both convex and concave asperities like, for example, pits, protrusions, or even sloped rock faces.

A plurality of microspine toes can be configured adjacent to one another (e.g., arrays of 20-40 microspine toes in a row) such that the plurality of microspine toes are in an opposing configuration so as to grip the surface from all directions, thus resisting, for example the forces of gravity.

However, a single row of a plurality of microspine toes can only grip the surface in one direction. In some embodiments an omni-directional anchor can be implemented using several sets of the plurality of microspine toes (e.g., eight sets of 30 toes each), each set attached to a substantially circular shaped (e.g., octagonal) center housing. Although an octagonal shaped center housing is described in the present embodiment, the person skilled in the art would understand that other shapes and configurations are possible to achieve substantially similar results. Each set of the plurality of microspine toes can be held in place by a leg that acts as a lever with the pivot point at an outer rim of the housing. The center of the housing can be hollow, providing an accessible location for mounting the anchor to the leg of a robot or placing a sampling tool like a coring drill. In some embodiments, additional macro-scale compliance elements can be implemented between each set of toes and the central housing. A latching mechanism can be included to allow the anchor to grip in a zero-power ON state.

Figure 1B:
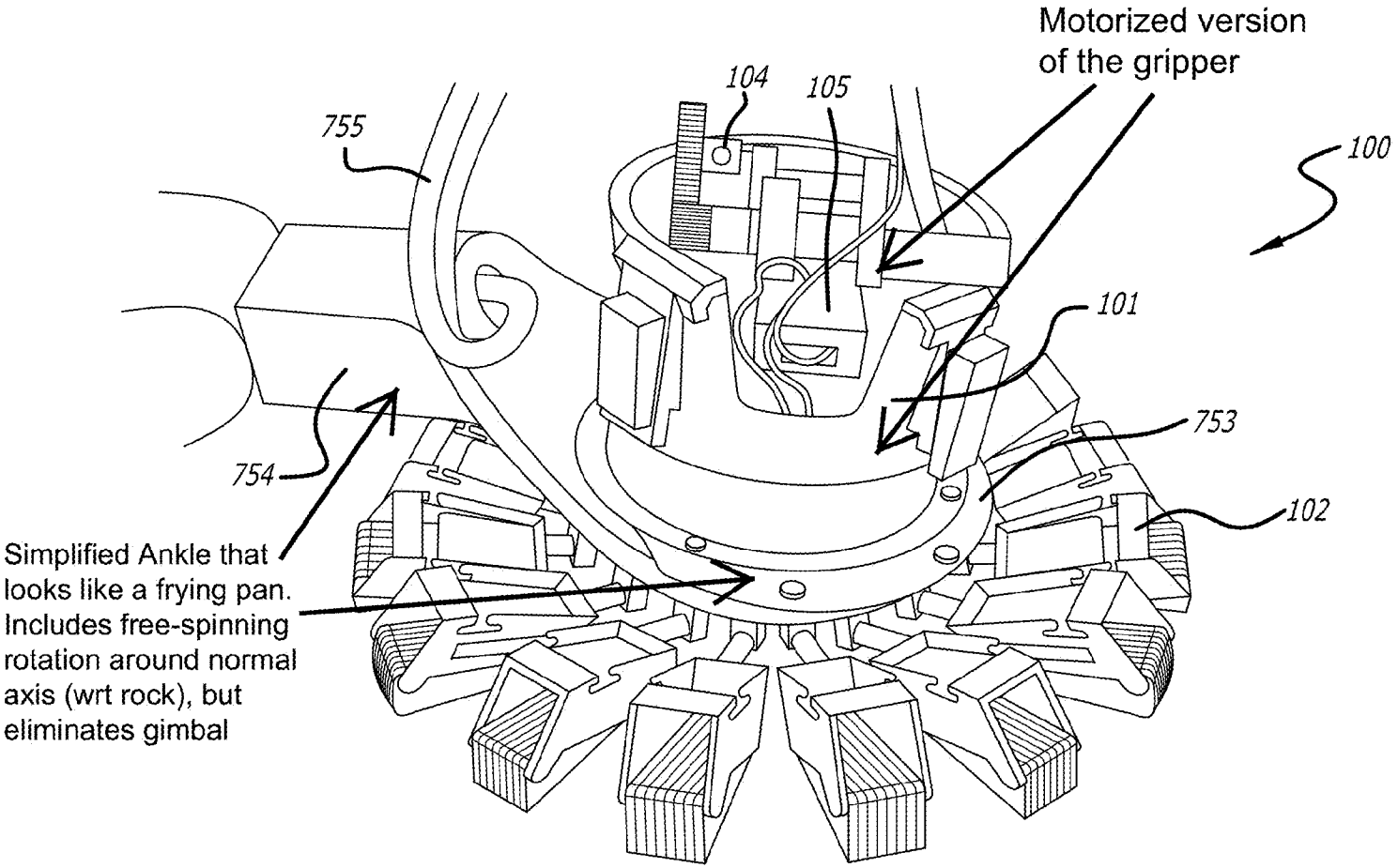
FIG. 1B shows a perspective view of a motorized gripping device, further connected with an ankle interface mechanism.

FIGS. 1A-1B show perspective views of the gripping device 100 according to various embodiments of the present disclosure. The gripping device 100 can comprise a center housing 101 which acts as the central portion where a plurality of carriages 102 (with adaptors) comprising microspines toes can be connected with. In this example, a plurality of microspine toes are arranged and contained in the carriages 102, which will be described in further detail later. The terms "gripper", "gripping device", "multi-dimensional gripper", and/or "gripper assembly" are interchangeable and intended to mean the same thing. The term "microspine assembly" is intended to refer to the carriage together with the plurality of microspine toes layered adjacent to each other.

Figure 2A:
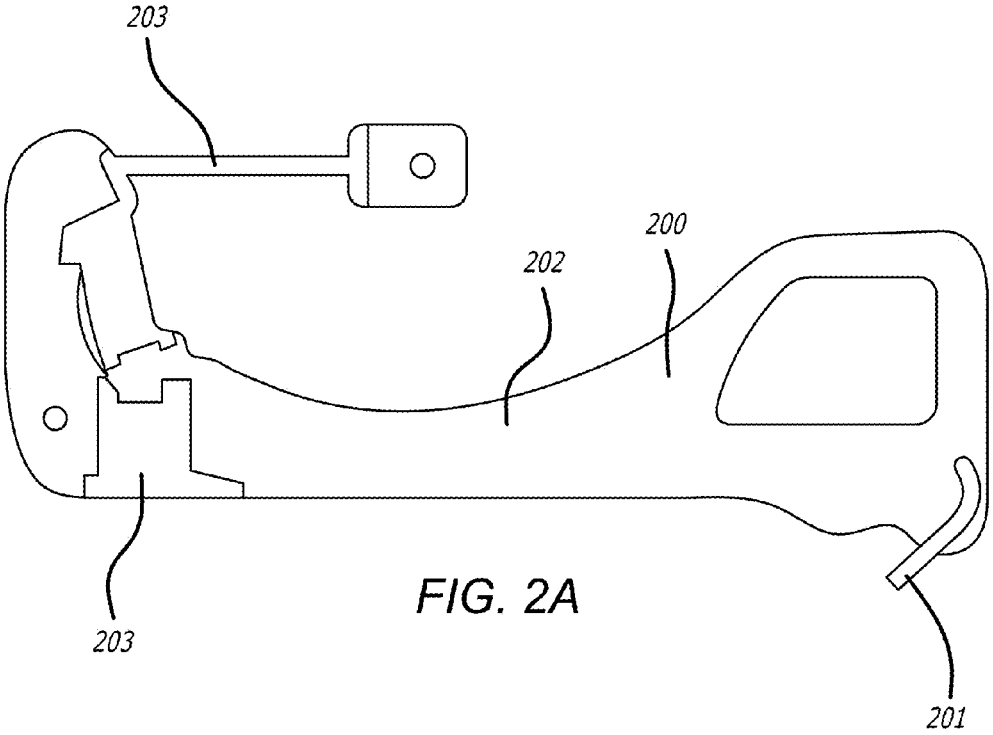
FIG. 2A shows a side view of a single microspine toe.

FIG. 2A shows a close up view of a single microspine toe 200, which further comprises a one or more embedded hooks 201 having sharp edges, angled inwardly toward the center of the housing (as seen when the microspine toes are mounted in the carriage and connected with the housing). Although the microspine toe 200 depicted in FIG. 2A shows only one steel hook 201, a person skilled in the art would recognize that different numbers of hooks 201 using different material can be implemented in a similarly designed microspine toe 200. For example, the plurality of microspine toes 200 depicted in FIGS. 2C and 3A show three hooks 201. Each of the microspine toes also has a rigid frame 202 and compliant flexures 203. The flexures 203 allow the hooks to move relative to its neighbors on its own suspension system such that when an array of toes is dragged along a surface, individual hooks can grasp asperities in the surface (e.g., rock) at various points as they encounter holding locations and share a fraction of the overall load supported by all of the microspine toes. In some embodiments and alternatively to the compliant flexures 203, springs (e.g., metal springs) can be used depending on the environment in which the gripper is being used. For example, in cold temperatures such as outer space, metal springs may be desirable. The independent stretching and force balancing can be seen in FIG. 2B, where the plurality of the microspine toes 200 are shown layered, one next to another, where neighboring toes have found various pits and bumps on the rock to grasp. In an alternative embodiment, the hooks can be angled outward and configure the actuators to push the carriages outwards (as opposed to pulling them inward).

Figure 2B:
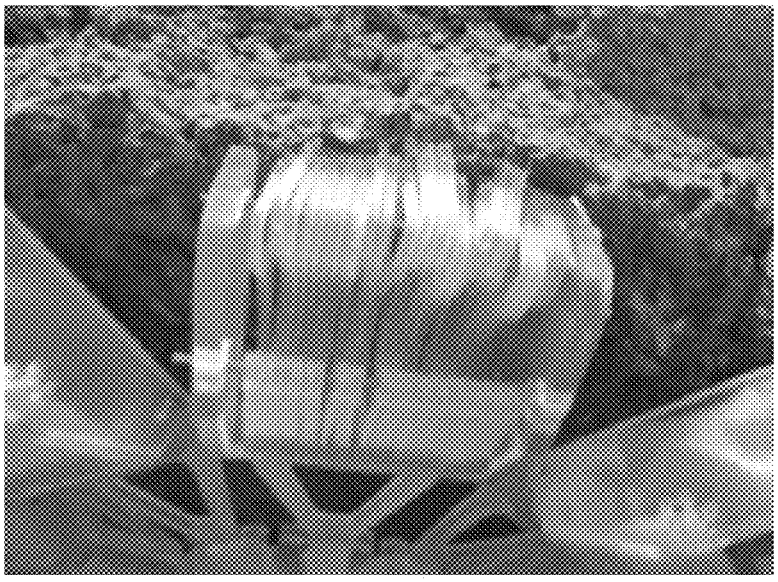
FIGS. 2B-2C show a plurality of microspine toes arranged in a row.
Figure 2C:
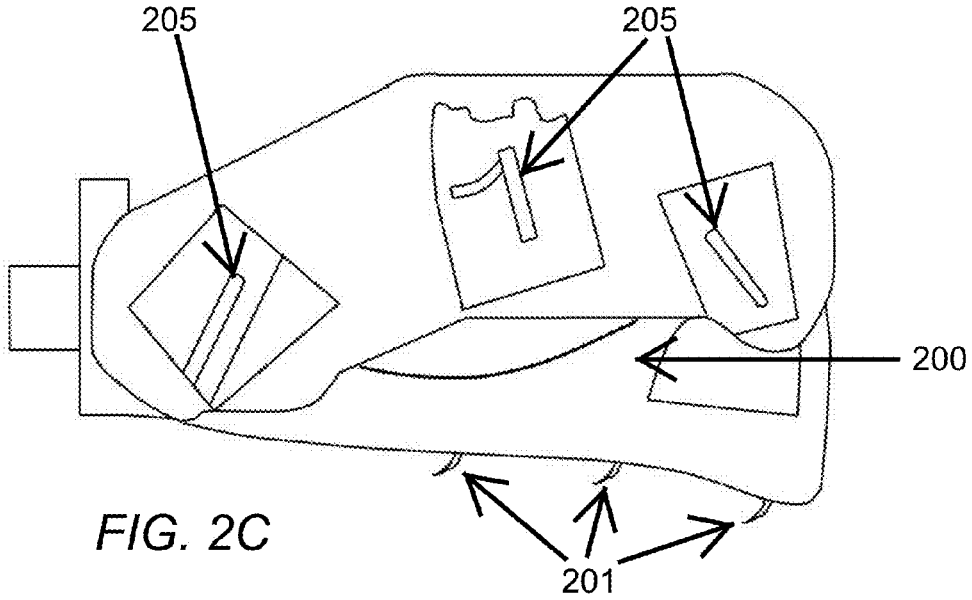
Figure 3A:
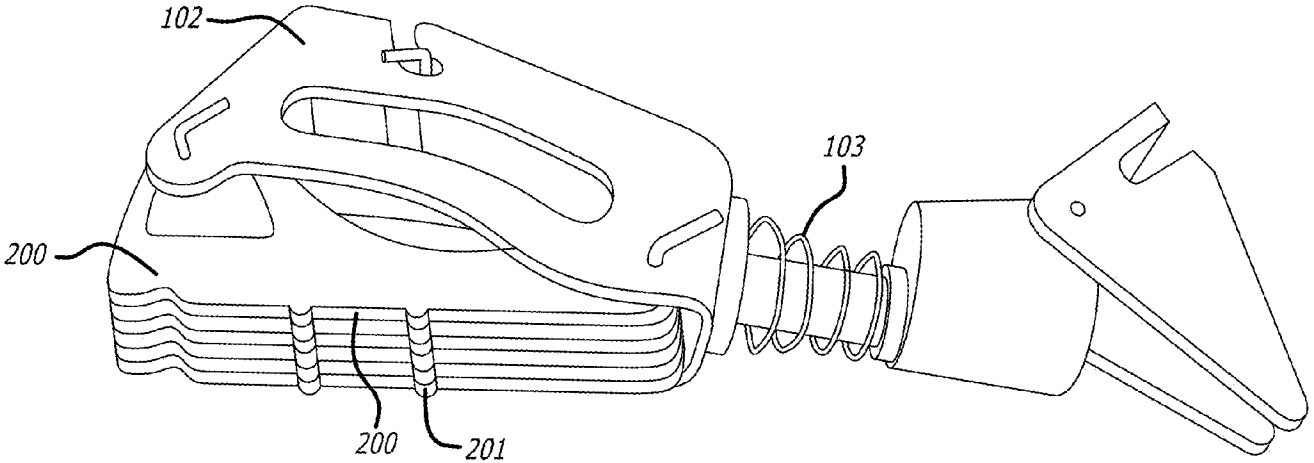
FIGS. 3A-3B show the plurality of microspine toes arranged in a carriage.

The row of microspine toes shown in FIG. 2B is configured to support loads in one direction. Therefore, in order for the gripping device to support loads in all directions (e.g., omni-directional anchor), the plurality of rows of toes can be arranged around a substantially circular (e.g., octagonal, hexagonal, etc.) center housing. By way of example and not of limitation, the embodiment of FIG. 2B includes 30 toes connected to a leg 206 (shown in FIG. 2C) that can act as a lever with a pivot point at an outer rim portion of the center housing.

Figure 2D:
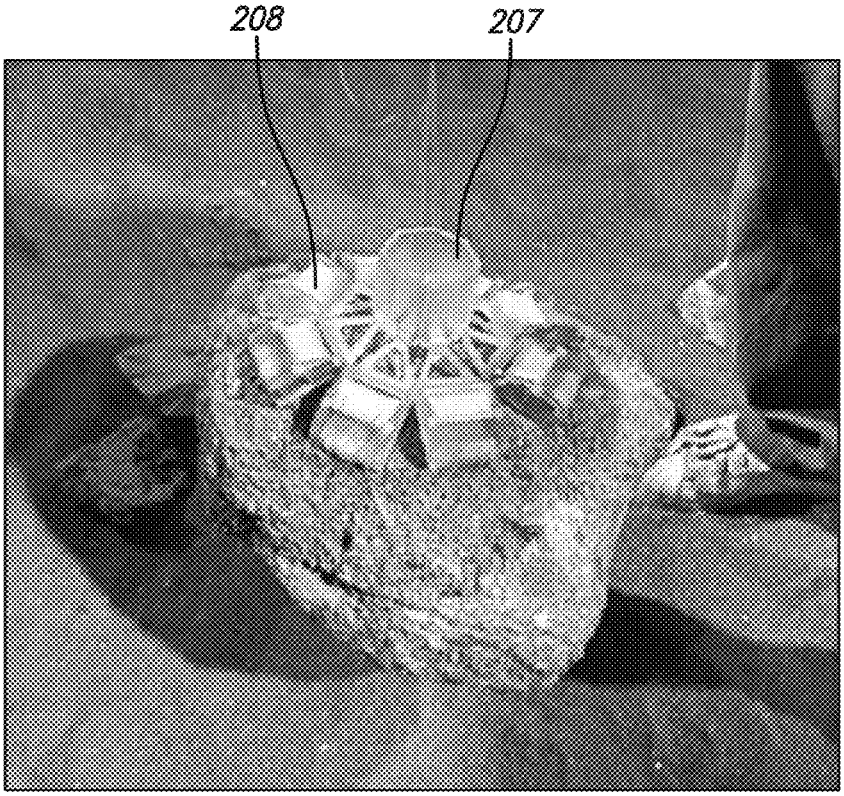
FIG. 2D shows the plurality of microspine toes connected to a center housing.

FIG. 2C shows a side view of the row of microspine toes 200, held together using pins. The leg 206 is shown connected to the row of microspine toes 200. FIG. 2D shows the gripper according to an example embodiment of the present disclosure comprising 8 sets of rows 208 of microspine toes connected with an octagonally shaped center housing 207.

As described earlier, in some embodiments, the plurality of microspine toes can be placed within the carriage 102, shown up close in FIG. 3A, such that device with the microspine toes 200, has substantially many (e.g., hundreds) hooks 201 adapted to grip the surface. These carriages 102 can be connected in a radial pattern along the circumferential perimeter of the housing 101 so that the microspine toes 200 can grip the surface. A person skilled in the art would recognize that carriages can be shaped and/or configured differently (e.g., simple, complex, light, heavy) and still be adapted to perform the same function of comprising the plurality of microspine toes.

Figure 3B:
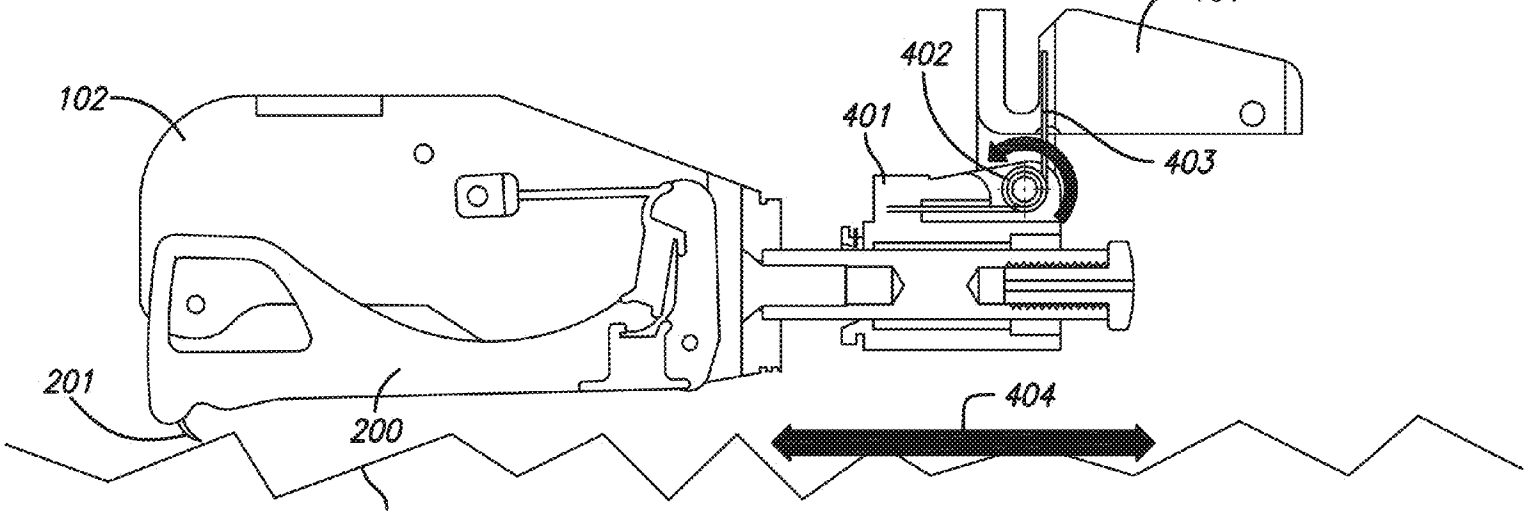
Figure 4:
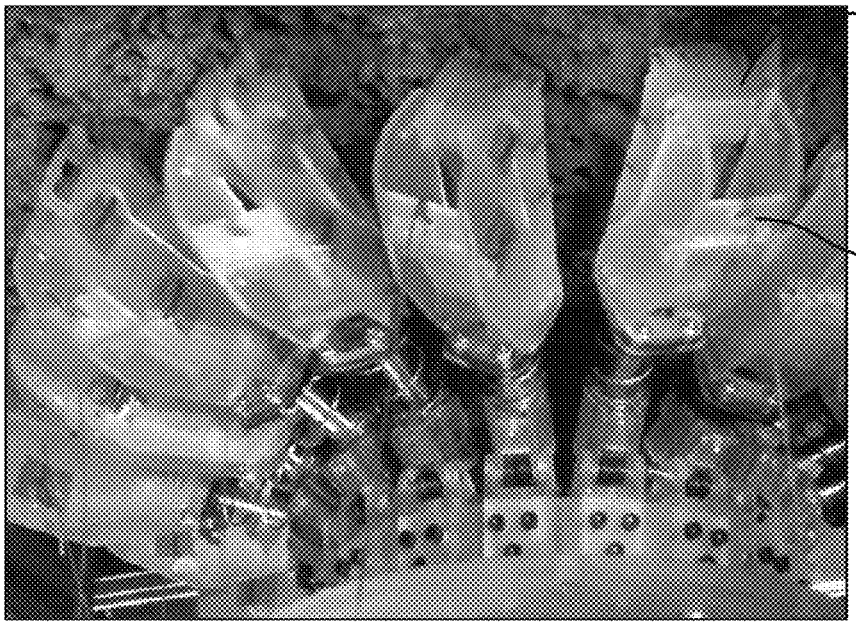
FIG. 4 shows a close-up view of the gripping device gripping a rock wall.

FIG. 3B shows a close up side view of a diagram of the carriage 102, comprising a plurality of microspine toes 200. In this example, one hook 201 is shown making contact with the asperities in the surface 400. The carriage 102 can have a movable leg 401 for connecting the carriage 102 with the center housing 101. The movable leg 401 is configured to slide either inwardly or outwardly as shown with an arrow 404. The movable leg 401 can be connected to the housing about a rotatable tensioned pivot 402. The tension can be provided, for example, by a torsion spring 403 in order to provide pressure to the carriage 102 via the movable leg 401 in a direction toward the surface 400. The pressure from the torsion spring 403 allows for the hooks 201 to dig into the surface thus gripping onto the surface. As mentioned earlier, the carriage 102 comprises many microspine toes 200, and thus the gripping device 100 which comprises many hooks 201 angled toward the center of the housing 101, grips the surface 400 omni-directionally. FIG. 4 shows a close up view of a plurality of microspine toes 200 in a plurality of carriages 102 gripping omni-directionally to an inverted surface (e.g., rock wall).

Turning back to FIGS. 1A-1B, FIG. 1B shows a motorized gripper 100 with an engagement motor 104 connected with the housing 101. The engagement motor 104 can be configured to move the carriages 102 via the movable legs 401 such that the gripping device engages the surface. More specifically, when the engagement motor 104 is activated, the engagement motor 104 pulls the carriages 102 toward the center thus allowing the hooks 201 to dig into the surface asperities. Each carriage has a series elastic spring that begins to stretch once two or more microspine hooks have achieved a grip. A torsion spring can bias the carriages into the surface so that the engagement actuator drags the hooks across the surface. Additionally, a disengagement motor 105 can be connected with the housing 101 to disengage the microspine toes from the surface by pulling the carriages 102 up and away from the surface, overcoming torsion from the spring bias, thus making it easier for the gripper to be removed from the surface. By way of example and not of limitation, the disengagement motor 105 can be a linear actuator that is adapted to pull cables that are attached to the ends of each of the carriages 102, thereby causing each carriage 102 to pivot upward (e.g., away from the surface) and overcoming the tension in the pivot caused by the torsion spring. However, persons skilled in the art would recognize that alternative configurations are possible with more or less motors, and/or with simpler or complex control over each element of the gripper.

Figure 5:
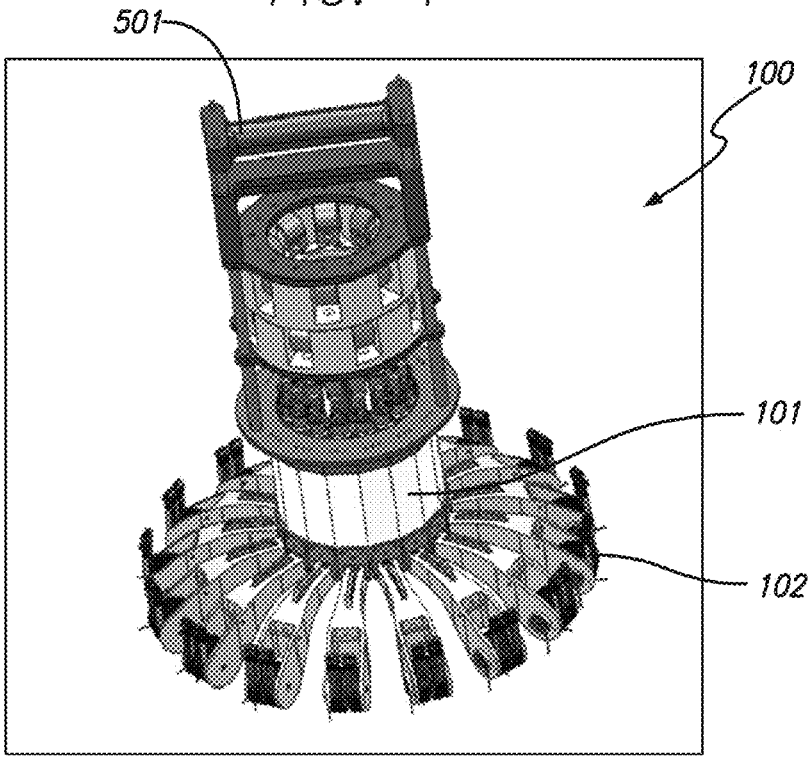
FIG. 5 shows the gripping device with a manual hand grip for actuating the microspine toes.

In some embodiments, the actuator for the gripper 100 can be a hand operated actuator 501 (e.g., manual hand grip), as shown in FIG. 5. As described before, the gripper 100 comprises a plurality of carriages connected to the central housing 101. According to this embodiment, a user can actuate the hand grip 501 by squeezing the hand grip 501 together, which causes the carriages 102 to move in the same way as if the engagement motor was activated, such that the carriages 102 is pulled toward the center, thus allowing the hooks 201 to digs into the surface asperities. In some embodiments, the gripper can further comprise a second set of cables connected to, for example, a second hand grip (not shown) or a finger trigger (not shown) to the ends of the carriages 102 such that the carriages 102 are pulled up and away from the surface, similar to when the disengagement motor is activated, thus making it easier for the gripper to be removed from the surface.

Figure 6A:
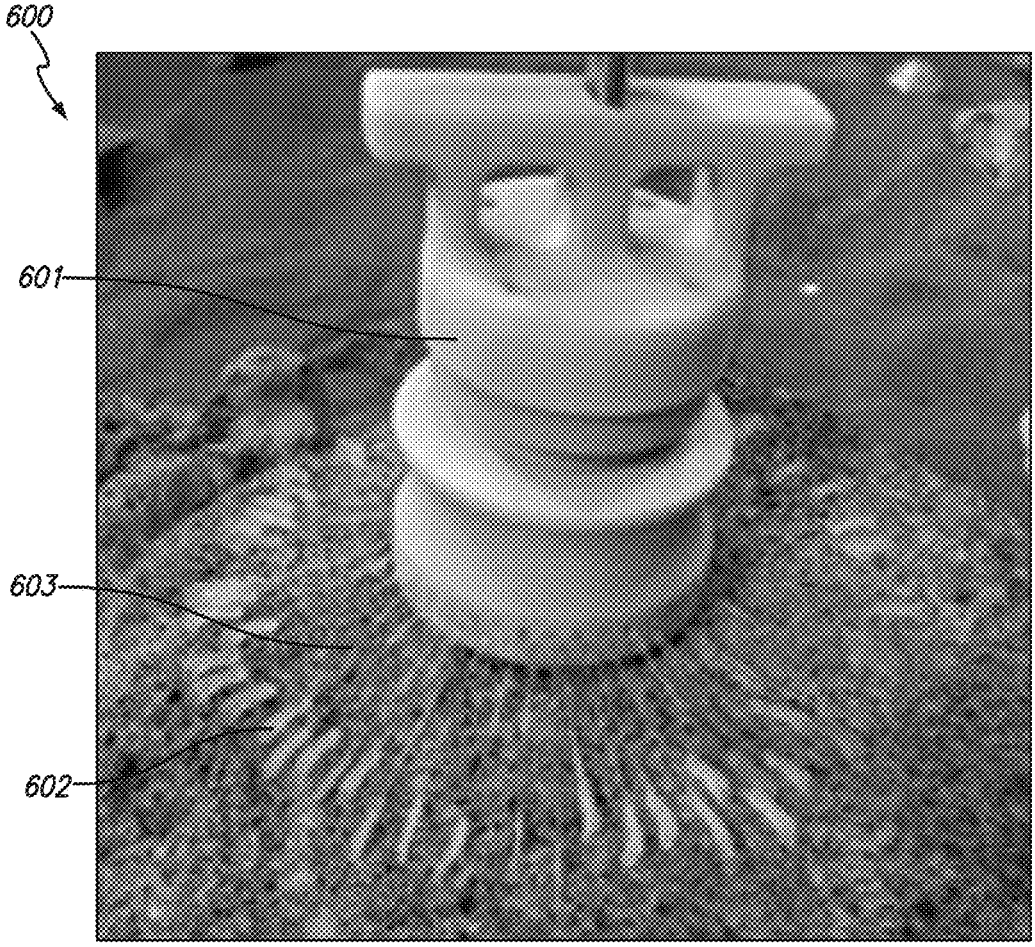
FIGS. 6A-6C show an alternative implementation of the gripping device according to various embodiments of the present disclosure.
Figure 6B:
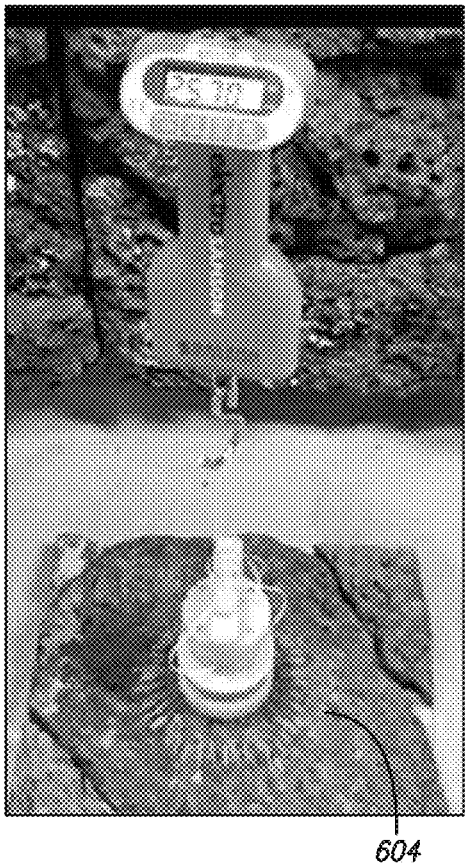
Figure 6C:
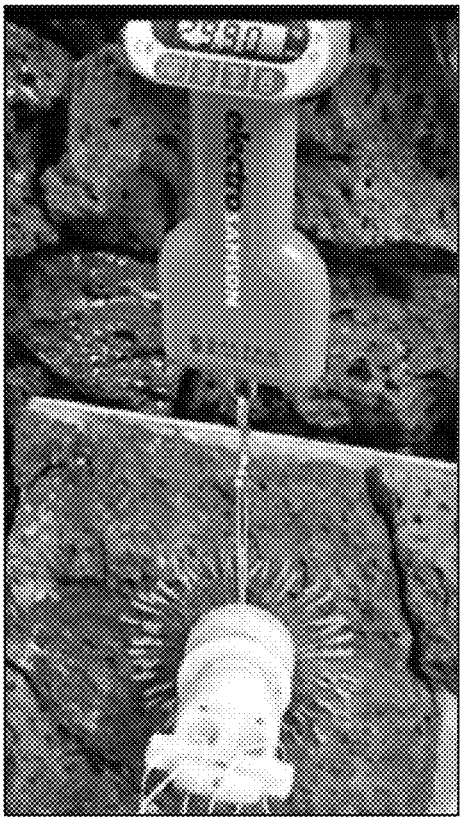

In some embodiments, the gripping device 600 can be implemented as shown in FIGS. 6A-6C. Differently from the embodiment according to FIGS. 1A-1B, instead of using carriages, steel wires 603 are connected to the center housing 601 and extend outwardly to form a hook 602 shaped tip. Moreover, in alternative embodiments, the hooks can be separate from the steel wires and bonded to the hooks according to methods know by those skilled in the art. Similarly to the embodiments shown in FIGS. 1A-1B, the plurality of hooks 602 can be actuated by an actuating mechanism whereby each of the steel wires 603 are pulled inwardly toward the center of the housing and/or upwardly away from the surface. FIG. 6B shows the gripping device 600 gripping onto a horizontal surface 604, while being pulled by 25.7 lbf a force normal to the surface. FIG. 6C shows the gripping device 600 gripping onto a substantially vertical surface, while being pulled by a 29.9 lbf force in a direction substantially planar to the surface.

Figure 7A:
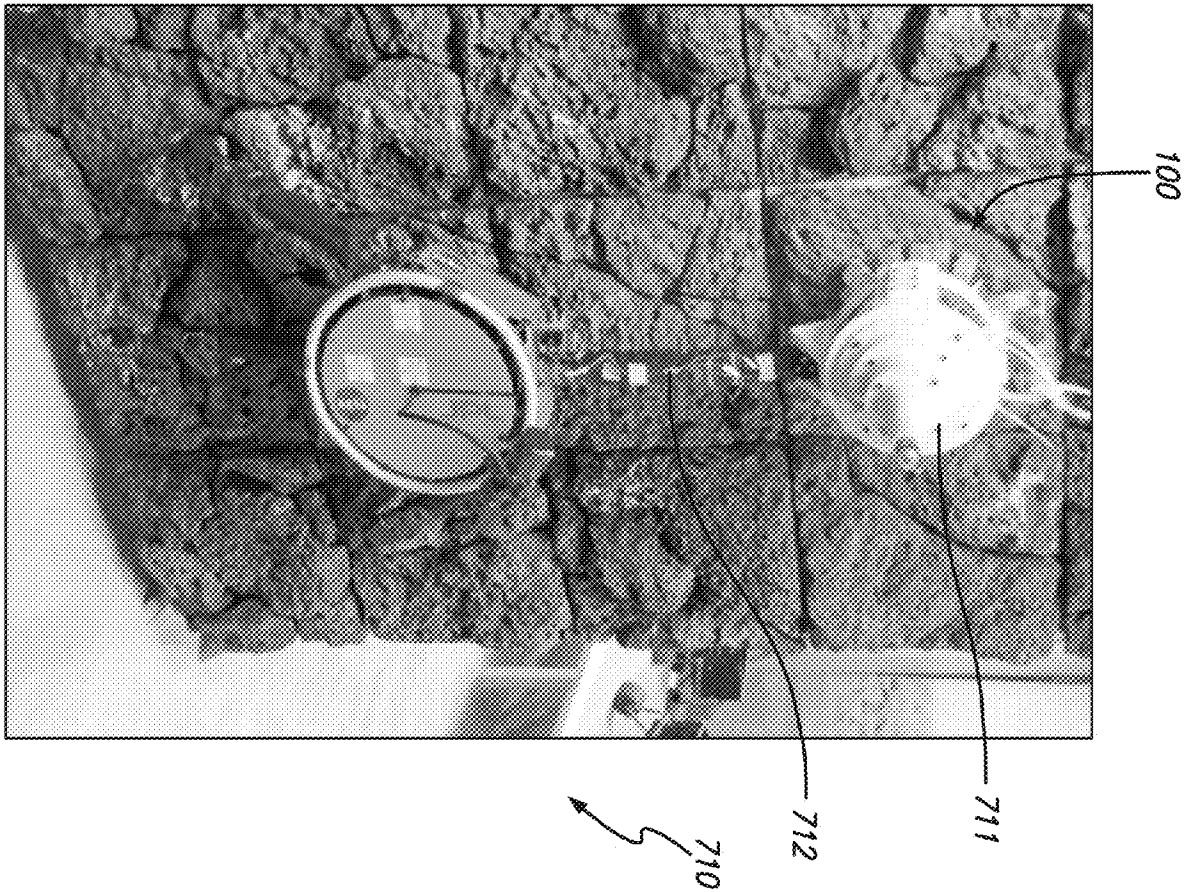
FIGS. 7A-7F show an ankle for use with the gripping device.

In some embodiments, the gripping device can be part of an overall system, for example, a robot having one or more gripping devices and actuation mechanisms to robotically engage and disengage the gripper, such as the Lemur IIB robot 710 shown in FIG. 7A. In such systems, the gripping device 100 can further comprise an interface between the gripper 100 and the robot 710, which will be referred to herein as an ankle 711, to allow the gripper 100 to passively comply with the surface (e.g., rock) to improve attachment strength. For example, the gripper (or the gripper with a drill/sampler) can be connected with a robotic appendage 712 (e.g., arm, limb, leg), which grips the surface.

While the gripper 100 can support large loads normal to the surface and in plane to the surface, the gripper can support less torques or moments. Applying torque to the gripper tends to twist the toes and the array housings causing the hooks to disengage with the surface. Therefore, in order to minimize the chance of this occurring while a robot attempts to use the grippers, an ankle 711 can be implemented with the gripper such that torques are not realized by the gripper. In other words, the ankle 711 distributes the forces caused by the system (e.g., robot) to the gripping elements (e.g., microspine toes, hooks, etc.) in a way that does not cause torques or moments on the gripper. Moreover, the ankle can be configured to spin freely about the axis normal to the wall. For example, when the robot takes a step using a gripping foot, the robot will attach to the rock surface and then rotate its arm, pushing itself up. However, the gripper will remain at a fixed orientation with respect to the wall while the ankle and limb rotate upwards. Therefore, the gripper spins within the ankle 711 while imparting minimal torque on the microspine toes.

In order to improve a success rate of the toes of the gripper engaging with a surface, many hundreds of toes are implemented in the gripper device according to various embodiments of the present disclosure. An ankle mechanism that can allow the gripper device conform to the macroscale orientation of the rock can increase the probability that microspines toes will find suitable asperities in the surface. Additionally, passive compliance is desirable since the orientation of the rock surface directly beneath the gripper can be unknown. Passive compliance to the surface will allow the system (e.g., robot) to climb rock faces without having to visually analyze the topography of the climbing surface. In addition, the ankle can comprise elastic components to bring the gripper back to a neutral position between steps.

Figure 7B:
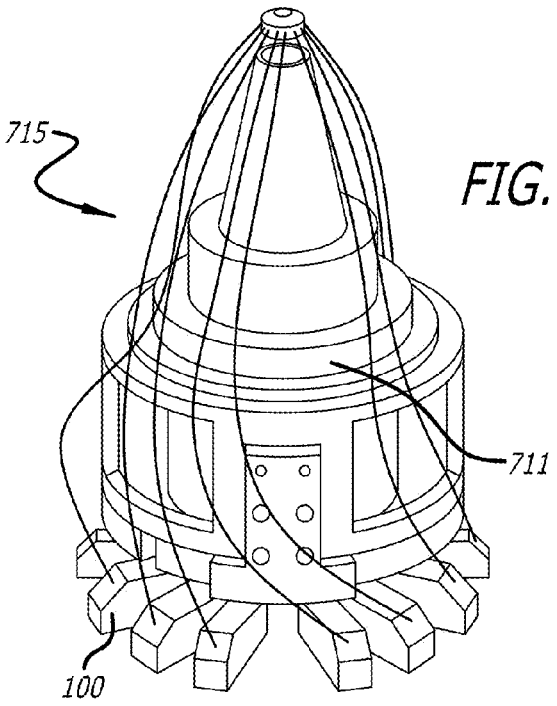
Figure 7C:
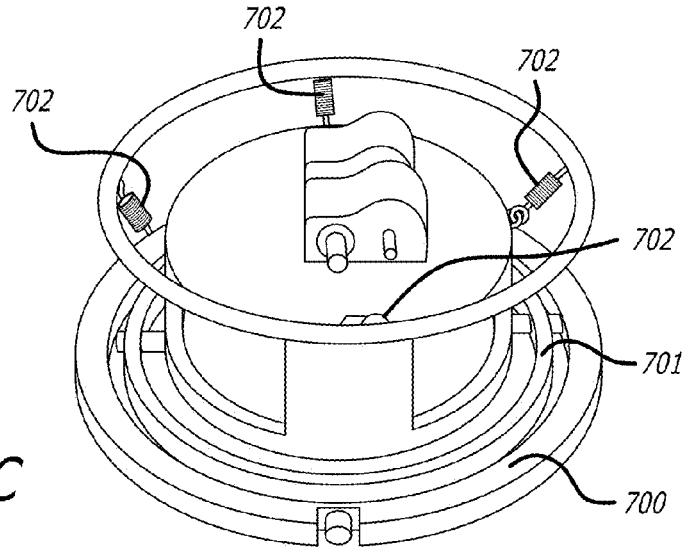

According to an embodiment of the present disclosure FIGS. 7B-7C show an exemplary ankle. FIG. 7B shows the entire assembled ankle mechanism, and FIG. 7C shows an interior portion of the ankle mechanism. The ankle can comprise a set of gimbals 700, 701 for compliance to the surface and torque neutralization. The gimbals can comprise two concentric rings mounted to orthogonal axes such that the combination of the two axes allows for the gripper to tilt and rotate in any direction, thus allowing or limiting the gripper to rotate, tip, and/or tilt around all axes so that when pushed against the surface (e.g., rock wall), the gripper can passively comply with the surface. Additionally, the gimbals do not transmit torques through their axes, which helps prevent the microspine toes from dislodging from the surface. Rotation about the normal axis to the wall is accomplished by allowing the outer ring to slide within C-shaped clamps (not shown), located inside the ankle housing 715 in FIG. 7B) that attach the gimbals to the outer housing of the ankle. These clamps fit loosely around the outer ring and can be lined with, for example, TEFLON® in order to generate the lowest possible coefficient of friction. This ensures that the gripper can spin, rotate, tip and/or tilt freely when the robot takes a step, while generating minimal torques on the microspine toes. FIG. 1B shows a close up view of an alternative ankle 754 configuration comprising radial bearing 753 instead of gimbals, which allows or limits rotating, tipping, and/or tilting freely.

Springs 702 can be mounted at the top of the housing of the ankle in a radial configuration to bring the gripper back to a neutral position. They are mounted at an upwards angle so that their line of action roughly intersects the axes of both gimbals to ensures that no matter which direction the gripper rotates, the springs always extend rather than compress. The springs 702 can be chosen to have a low spring constant (e.g., 0.78 lbs/in) to avoid inducing large torques on the microspine toes. The springs have sufficient stiffness to be able to keep the gripper substantially horizontal when the ankle is horizontal.

In some embodiments, a linear actuator (e.g., Firgelli L12) can be mounted at the top of the ankle to disengage the microspine from the surface. The linear actuator pulls on wires mounted to each individual microspine array to pull them up and away from the wall. By way of example and not of limitation, a force of approximately 5 pounds can be applied over a 2 inch distance in order to disengage the microspines from a rock surface. Moreover, more than one motor (e.g., linear actuator) can be used in parallel on the gripper so as to allow greater force to be applied to the wires pulling the microspine array.

In some embodiments, a braking mechanism can be implemented in the engagement motor to prevent the motor from rotating when the wires are fully tensioned, thus preventing the motors from backdriving.

Figure 7D:
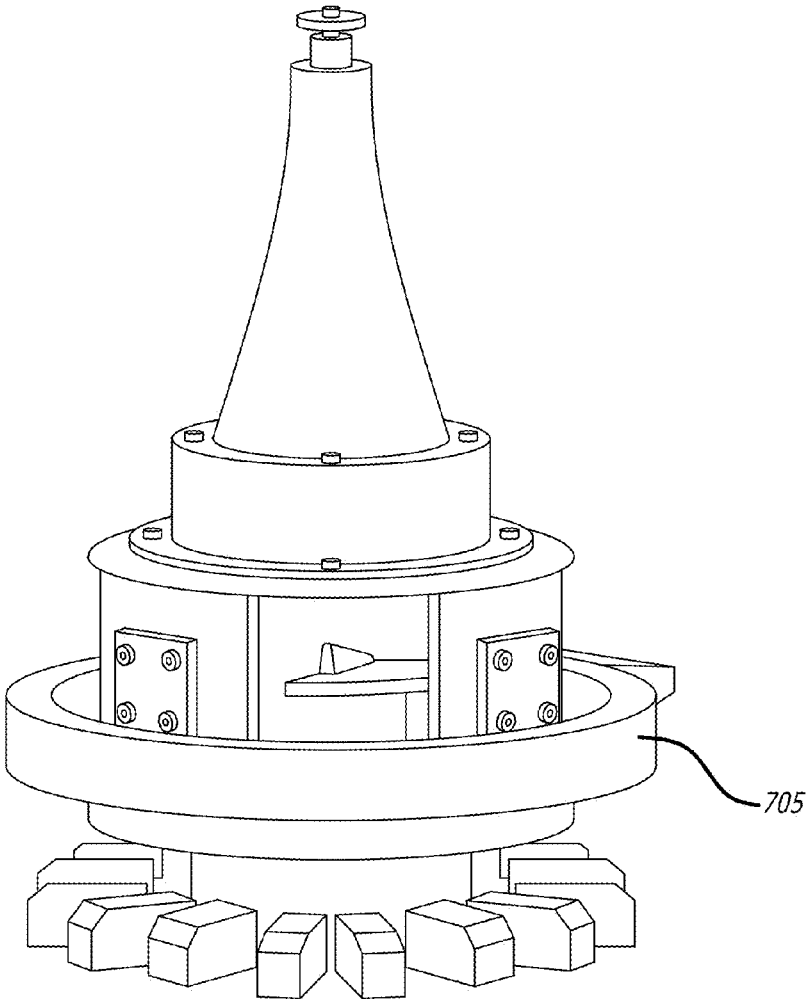

In some embodiments, a sliding ring 705 that is adapted to provide rotation about the normal axis to the surface can be mounted exterior of the outer housing as shown in FIG. 7D in order to prevent the wires from getting caught on the various components of the ankle. By mounting the sliding ring 705 on the exterior of the outer housing, the entire ankle assembly can spin as one unit and prevents the disengagement wires from having to travel around the outer housing, thus decreasing the likelihood that the wires will get caught. Moreover, the electrical wires for the motor can be connected through a slip ring, commonly known by those skilled in the art, to allow sliding contacts between the wires.

Figure 7E:
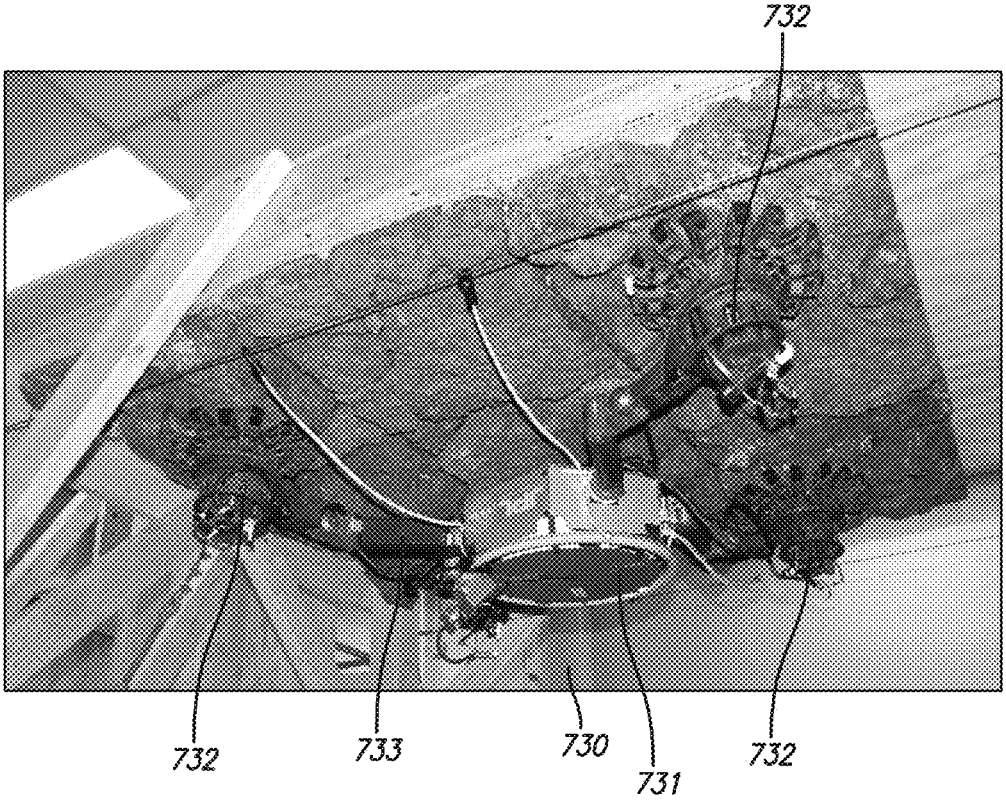
Figure 7F:
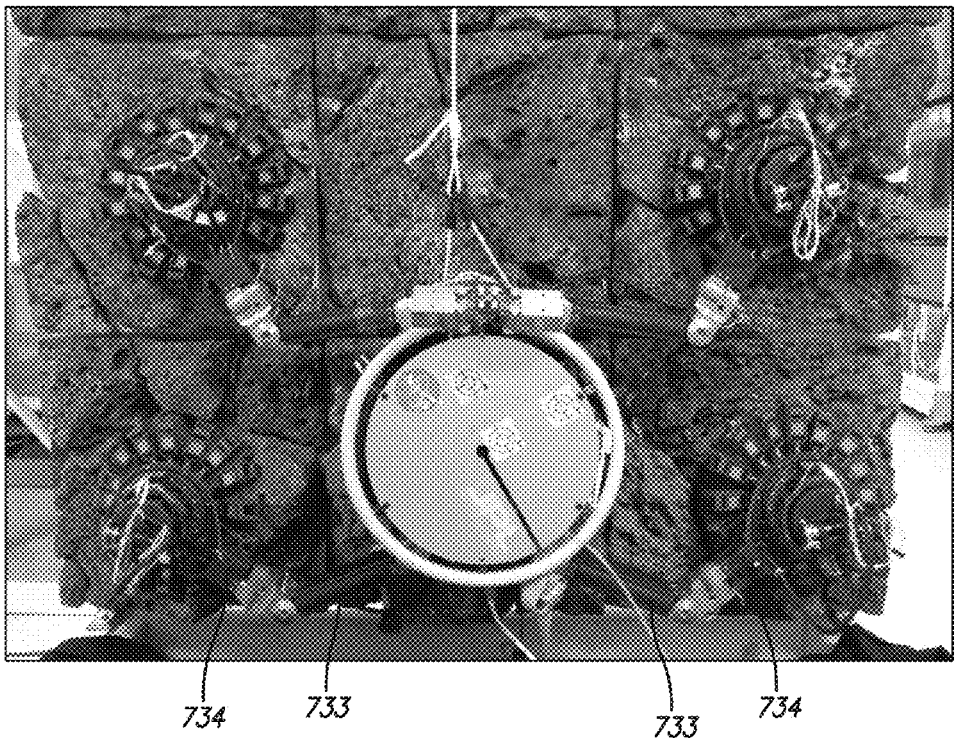

FIGS. 7E-7F show an exemplary system (e.g., robot) 730 having four grippers 732 connected to a body 731 via arms 733. FIG. 7E shows the robot 730 gripping an inverted rock wall (e.g., ceiling) and FIG. 7F shows the robot 730 gripping a substantially vertical rock wall. The grippers shown in these embodiments comprise ankles 734 that are simplified compared to the ankles 711 shown in FIGS. 7A-7D. By way of example and not of limitation, the body 731 of the robot can comprise computers or controllers that can be electrically connected to the engagement/disengagement motors of the grippers 732 to direct the grippers to grip the surface or release the surface. A person skilled in the art would recognize that the body 731 can have a variety of sizes and shapes according to the objective and environment in which the robot going to be operated.

Differently from the ankles shown in FIGS. 7A-7D, the simplified ankles 711 shown in FIGS. 7E-7F (also shown up close in FIG. 1B) does not have gimbals, but is configured to provide free rotation, tipping and/or tilting about an axis normal to the surface. In this configuration, the electrical wires for the motor can be connected through a loose cable 755 (in FIG. 1B) so that the gripper 732 can rotate and move without pulling on the electrical wires.

Figure 8A:
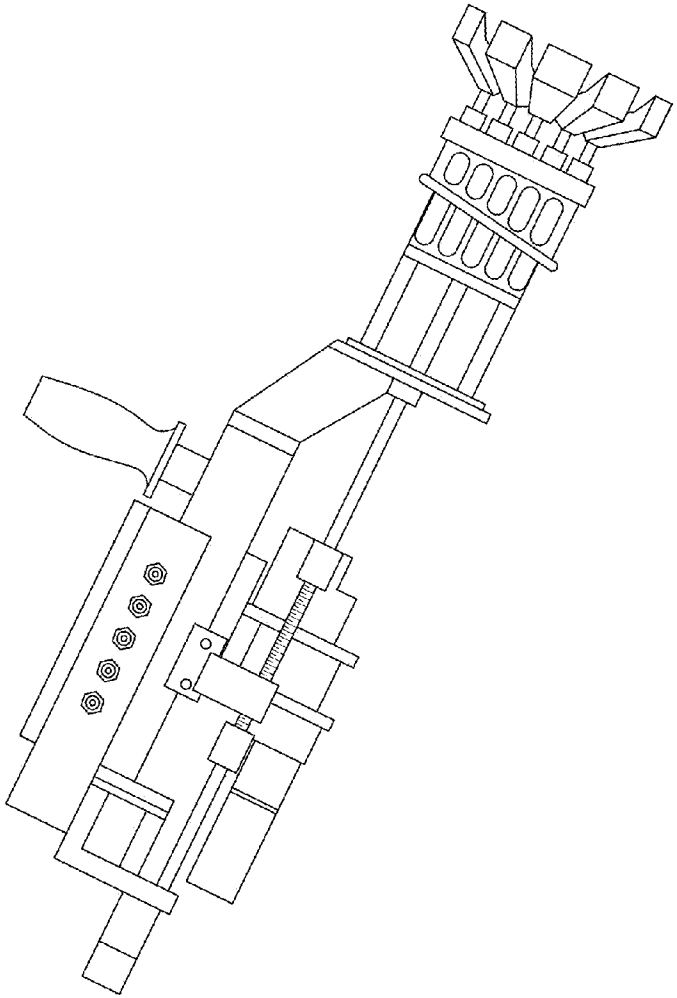
FIGS. 8A-8B show two examples of a gravity-independent drill connected with the gripping device.
Figure 8B:
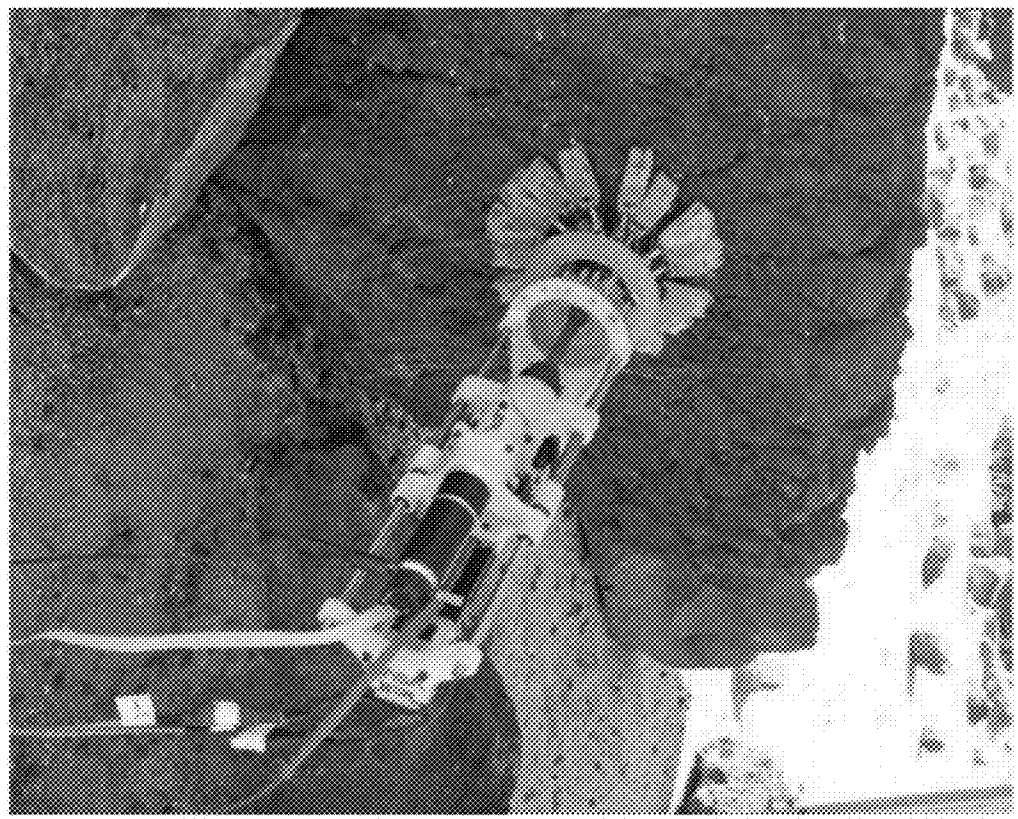
Figure 8C:
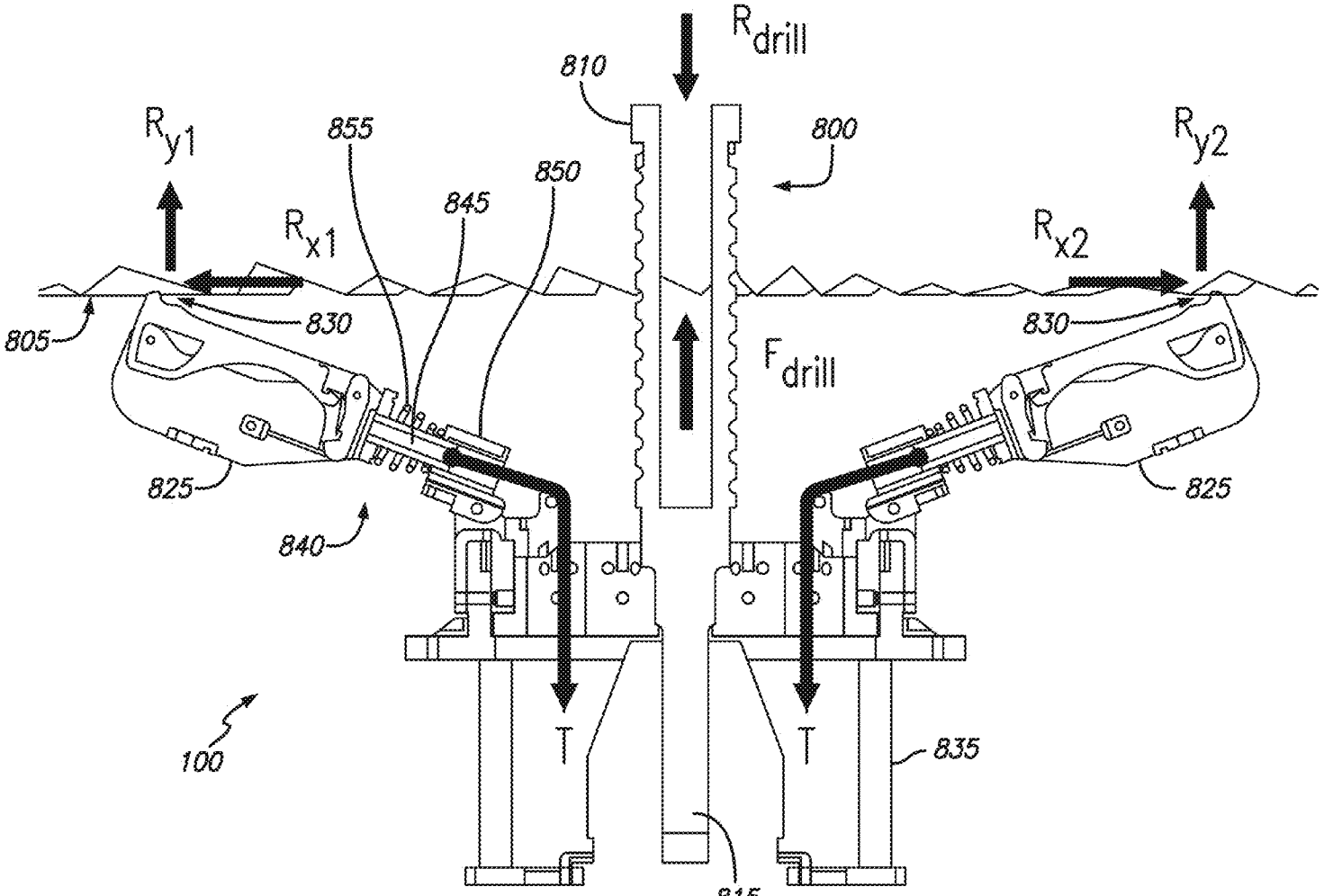
FIG. 8C shows a cross-sectional view of an object anchored to a surface using a multi-dimensional gripper assembly incorporating a sub-assembly, which is a drill in this example embodiment.

FIG. 8C shows a cross-sectional view of an object 800 anchored to a surface 805 using a multi-dimensional gripper assembly 100 in accordance with the present disclosure. Object 800 (alternatively referred to herein as a drill and gripper system) may be an independent self-standing object, or may be a part of a larger object, such as a robot that performs multiple tasks, only some of which require an anchoring action. For example, the robot can be a rover that moves around on a Martian surface performing a number of functions. Consequently, one arm of the rover may include the multi-dimensional gripper assembly as part of a drilling device for drilling into the Martian surface, while another arm of the rover may omit the multi-dimensional gripper so as to carry out other tasks that do not require anchoring the rover to the Martian surface.

In the example embodiments shown in FIGS. 8A-8C, multi-dimensional gripper assembly 100 is adapted to accommodate a sub-assembly. In this example embodiment, the sub-assembly is a drilling device 800. Specifically, FIG. 8A shows an example hand drill that implements a drill and gripper system according to the present disclosure having handles and switches adapted to be used by an operator wearing heavy gloves (e.g., astronaut gloves). FIG. 8B shows a drill with the drilling a hole in a substantially vertical rock wall, while the gripper grips the wall. In other embodiments, drilling device 800 may be replaced by other sub-assemblies, such as, for example, a sensor, a penetrometer, a shear tester or a chemical sampler.

Drilling device 800 includes a drill bit 810 and a reciprocating shaft 815 that can move back and forth in a hollow casing 835 that is a part of a central housing 820. As is known, a minimum force referred to a weight-on-bit (WOB) is required for a drill bit to penetrate a surface. The WOB force is normally countered by gravity when the drilling surface is located in a positive gravity environment such as earth or the moon. However, the WOB force cannot be countered in a zero gravity environment and as a result, drilling device 800 is pushed away from the drilling surface. Multi-dimensional gripper assembly 100 is used to counter the reactive force that is generated when drilling device 800 is operated in a zero gravity environment (as well as in certain low gravity environments).

However, the use of multi-dimensional gripper assembly 100 is not limited to zero gravity or low gravity environments. To elaborate upon this statement, as can be understood, there are many situations in a positive gravity environment, such as on earth, where the positive effects of gravity cannot be exploited to counter the reactive force generated when a prior art drilling device is used to drill a hole in a surface.

As one example of such a situation, when a prior art drilling device is used to drill a hole in a ceiling of a building on earth, gravity tends to make the drilling device fall away from the ceiling rather than helping the drill bit grip the ceiling and advantageously assist the drill bit enter the ceiling. In other words, earth's gravity supplements the WOB force rather than countering it. Similarly, when a prior art drilling device is used to drill a hole in a vertical wall (or at certain other angles) in the building, gravity tends to supplement the WOB force, which in combination with the weight of the device, tends to make the device fall towards the ground rather than help grip the surface.

In contrast, multi-dimensional gripper assembly 100 provides a gripping action irrespective of the presence of gravity. This advantageous feature of multi-dimensional gripper assembly 100 is referred to herein as a "gravity-independent" grip because the gripping action permits drilling operation to be carried out in a variety of gravity environments (positive, low, or zero gravity for example) and also at a variety of penetration angles.

FIG. 8C shows several reactive forces that are in play when multi-dimensional gripper assembly 100 is anchored on to surface 805 and drill bit 810 penetrates surface 805. Specifically, the WOB force is directly proportional to the strength of attachment between surface 805 and an array of microspines 830 contained in carriage 825 of a grabber assembly of multi-dimensional gripper assembly 100. The grabber assembly may be implemented in other ways in other embodiments, such as for example a wire assembly arrangement described elsewhere in this disclosure.

The relationship between the various reactive forces can be defined by the following set of equations, which are applicable to the two leg assemblies shown in FIG. 8C.

$$R_{drill}=R_{y1}+R_{y2} \tag{1}$$

$$R_{x1}=R_{x2} \tag{2}$$

However, it will be understood that a more universal equation that is applicable to multiple ("n") leg assemblies (rather than merely the two leg assemblies shown in the cross-sectional view of FIG. 8C) that are provided in multi-dimensional gripper assembly 100 in accordance with the disclosure, can be defined as follows:

$$R_{drill}=R_{y1}+R_{y2}+R_{yn} \tag{3}$$

Equation (2) above, which is applied to the single pair of leg assemblies shown in FIG. 8C can be applied to similar pairs of opposing leg assemblies in the "n" leg assemblies.

A cable (not shown) with a series elastic element is used to load each of the array of microspines 830 contained in carriage 825. Carriage 825 is attached to a dowel pin 845 that is free to slide within a sleeve bearing 850. A conical spring 855 returns carriage 825 to a fully extended position between each application. By applying tension to the cable, the microspines are dragged along surface 805 thereby providing opportunities to catch on to irregularities (small pits, bumps, and slopes on surface 805). This tension also creates a moment about a pivot point (not shown) where leg assembly 840 is connected to central housing 820, thereby pushing the microspines into the rock surface during engagement. A torsion spring around this pivot point biases the carriages into irregularities in surface 805, such that the microspines retain anchor even in zero gravity or suspended configurations. By varying the length of the dowel pin and the angle at which the cable pulls on carriage 825, the magnitude of these two effects can be traded against one another. The relationship is described by:

$$\Sigma M_{+}=M_k+T*d3-R_x*d_2-R_y*d_1 \tag{4}$$

where T is the tension in the cable, $M_k$ is the moment created by the torsion spring, $R_x$ and $R_y$ are the reaction forces of the rock acting on the hook, and $d_1$, $d_2$, and $d_3$ are the lengths of relevant moment arms.

Figure 9:
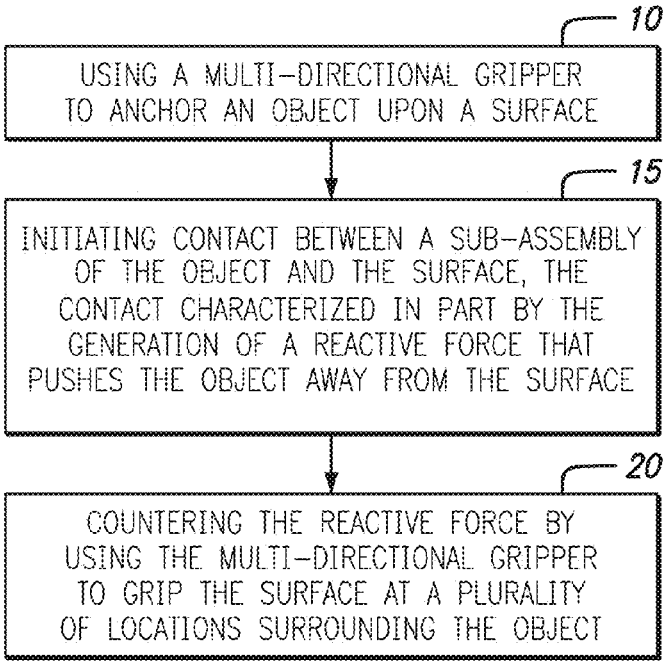
FIG. 9 is a flowchart depicting a first method of using the multi-dimensional gripper assembly in accordance with the present disclosure.

FIG. 9 is a flowchart depicting a first method of using the multi-dimensional gripper assembly in accordance with the present disclosure. In block 10, a multi-directional gripper is used to anchor an object upon a surface.

In block 15, contact is initiated between a sub-assembly of the object and the surface. One example of a sub-assembly is drill bit 810 described above. As further described above, this contact is characterized in part by the generation of a reactive force that pushes the object away from the surface.

In block 20, the reactive force is countered by using the multi-directional gripper assembly to provide a gravity-independent grip upon surface 805 at a plurality of locations surrounding the object. The nature of this gripping action at a plurality of points (in a substantially circular manner around the central housing 820) coupled with this action taking place in a gravity-independent manner differentiates this method from prior art methods wherein one or more gripping points are used to compensate for the effects of gravity.

Specifically, for example, in the case of a prior art robot (or human) climbing up a wall, the gripping action is typically enabled only above the prior art robot (or human) so as to prevent the prior art robot (or human) from falling off the wall. Anchoring is not needed on the wall below the prior art robot (or human) because gravity provides assistance in climbing the wall. However, as can be understood, this top-anchor only approach would not be effective in a zero gravity environment and the prior art robot (or human) would float away from the wall whenever a part of the climbing robot (or human) pushes against the wall in a horizontal or angular direction.

In contrast, a robot in accordance with the disclosure provides a gripping action on multiple locations not just above the robot but below the robot as well. The use of these multiple gripping points allows the robot to provide a gripping action irrespective of the presence or absence of gravity and irrespective of the angle of force applied against the surface.

Furthermore, unlike in the zero gravity case, a prior art robot climbing up a wall is not subjected to a reactive force that pushes the robot away from the wall to any significant extent. In contrast, a prior art robot operating on Mars would be pushed off the Martian surface in a variety of directions opposing any force that is applied by the prior art robot on any type of surface (horizontal, vertical, inverted, or angular).

The examples set forth above are provided to give those of ordinary skill in the art a complete disclosure and description of how to make and use the embodiments of the present disclosure, and are not intended to limit the scope of what the inventors regard as their disclosure. Modifications of the above-described modes for carrying out the disclosure may be used by persons of skill in the art, and are intended to be within the scope of the following claims. All patents and publications mentioned in the specification may be indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a", "an", and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications may be made without departing from the spirit and scope of the present disclosure. Accordingly, other embodiments are within the scope of the following claims.

The invention claimed is:

1. A gripping device comprising:

a center housing;

an array of hooks circumferentially distributed around the center housing, the array of hooks adapted to grip a surface on which the array of hooks rest;

one or more actuators connected with the center housing and the array of hooks, the one or more actuators operative to cause the array of hooks to grip or release the surface; and an array of microspine assemblies, each microspine assembly comprising a plurality of microspine toes layered adjacent to each other within a same microspine assembly, one or more hooks of the array of hooks being embedded in each microspine toe.

2. The device according to claim 1, wherein the hooks comprise sharp edges.

3. The device according to claim 1, wherein each microspine assembly comprise a carriage holding the plurality of microspine toes, the microspine toes being made of a flexible material such that elasticity of the flexible material allows the hooks to grasp asperities in the surface.

4. The device according to claim 3, wherein the one or more actuators comprise motors.

5. The device according to claim 4, wherein the motors comprise engagement motors and/or disengagement motors, the device further comprising:

a first set of cables connecting the carriage to the engagement motors; and a second set of cables connecting the carriage to the disengagement motors, wherein the engagement motors are operative to pull the first set of cables thus gripping the surface, when in operation, and wherein the disengagement motors are operative to pull the second set of cables, thus releasing the surface, when in operation.

6. The device according to claim 3, further comprising springs connected with the carriage, the springs biasing the array of hooks into the surface to further grip the surface during operation of the device.

7. The device according to claim 1, wherein the one or more actuators are hand operated actuators.

8. The device according to claim 1, further comprising wires connecting the array of hooks to the one or more actuators, the wires operative to be pulled or released by the one or more actuators.

9. The device according to claim 8, wherein the one or more actuators comprise motors.

10. A device comprising:

a substantially ring-shaped mechanism surrounding a gripping device, the substantially ring-shaped mechanism operative to freely spin around the gripping device about an axis normal to a surface upon which the gripping device grips during operation of the gripping device, the substantially ring-shaped mechanism being an interface between the gripping device and a robotic system, wherein the gripping device comprises:

a center housing;

an array of hooks circumferentially distributed around the center housing, the array of hooks adapted to grip a surface on which the array of hooks rest; and one or more actuators connected with the center housing and the array of hooks, the one or more actuators operative to cause the array of hooks to grip or release the surface.

11. The device according to claim 10, wherein the robotic system comprises an arm, the arm being connected with the substantially ring-shaped mechanism.

12. The device according to claim 11, wherein the robotic system is a walking robot.

13. The device according to claim 10, wherein the robotic system comprises a body and an arm, the device being connected with the body of the robotic system.

14. The device according to claim 10, further comprising gimbals connected with the substantially ring-shaped mechanism.

15. The device according to claim 10, further comprising a radial bearing connected with the substantially ring-shaped mechanism.

16. The device according to claim 10, further comprising a slip ring, the slip ring electrically connecting the one or more actuators with electrical connections of the robotic system.

* * * * *